United States Patent [19]

Jaquez

[11] Patent Number: 4,582,256

[45] Date of Patent: Apr. 15, 1986

[54] SPRINKLER HEAD AND RISER PROTECTOR

[76] Inventor: Salome M. Jaquez, 3554 Behler Dr., San Jose, Calif. 95132

[21] Appl. No.: 706,019

[22] Filed: Feb. 27, 1985

[51] Int. Cl.[4] ..... B05B 1/28

[52] U.S. Cl. ..... 239/288.5

[58] Field of Search ..... 239/203, 204, 205, 206, 239/288, 288.3, 288.5

[56] References Cited

U.S. PATENT DOCUMENTS

| | | | |
|---|---|---|---|
| 2,075,589 | 3/1937 | Munz | 239/204 |
| 2,796,293 | 6/1957 | Becker | 239/204 |
| 3,662,956 | 5/1972 | Hedman | 239/288.5 X |
| 3,904,120 | 9/1975 | Sbicca | 239/288.5 X |
| 4,146,181 | 3/1979 | Soos | 239/288.5 |
| 4,429,832 | 2/1984 | Sheets | 239/288.5 X |

*Primary Examiner*—Joseph F. Peters, Jr.
*Assistant Examiner*—Patrick N. Burkhart
*Attorney, Agent, or Firm*—Paul L. Hickman

[57] ABSTRACT

An improved protector for a sprinkler head and for the riser to which it is attached characterized by a guard which allows the sprinker head to "float" within an axial cavity. The guard has a bottom surface area which is much greater than the top surface area, greatly diluting the pressure exerted on ground beneath the guard. A two piece cover assembly and breakaway poppet guide also prevent forces which may be exerted upon the guard from being transmitted to the sprinkler head or the riser. Slots are provided in the guard to allow the protector to be used near the edge and in the corner of lawns.

9 Claims, 3 Drawing Figures

SPRINKLER HEAD AND RISER PROTECTOR

BACKGROUND OF THE INVENTION

1. Field of the Invention

This invention relates generally to irrigation systems, and more particularly to sprinkler head guards.

2. Description of the Prior Art

An irrigation or sprinkling system typically includes a matrix of buried water pipes, a number of vertically oriented pipe (known as risers) attached to the buried water pipes, and a sprinkler head attached to the top of each riser.

While there are many types of sprinkler heads, a common type includes a base, a spray nozzle, and a poppet attaching the spray nozzle to the base. When water pressure is applied to the base of the sprinkler head through the riser, the poppet is caused to move from a retracted to an extended position, elevating the spray nozzle.

In a typical home installation, the sprinkler heads are mostly buried in the ground, with only their upper surface being at ground level. The poppet elevates the spray nozzle above the ground level for effective dispersal of the water. A problem encountered with this type of installation is that it can be easily damaged by being stepped upon, mowed over, etc.

To combat this problem, a number of individuals have developed protectors or guards for sprinkler heads. For example, U.S. Pat. No. 3,904,120 of Sbicca teaches a thick, plastic disk adapted to be recessed into a lawn around a sprinkler head. The disk is molded in one piece and is provided with a central aperture having a shoulder which contacts and supports a radial flange of the sprinkler head.

A problem with sprinkler head protectors of the prior art is that while they adequately protect the sprinkler head itself, they do not protect the riser connecting the sprinkler head to the buried water pipes. In consequence, the risers, which are usually made from fragile polyvinylchloride (PVC) plastic, are often broken and must be dug out and replaced.

For example, with the sprinkler head protector of Sbicca, any vertical load exerted on the protector will cause the shoulder within the cavity of the protector to exert a force on the sprinkler head's flange. The relatively strong sprinkler head (which is typically made from a metal such brass) will transmit this force to the easily breakable riser.

SUMMARY OF THE INVENTION

An object of this invention is to provide a protective device which protects both a sprinkler head and the riser to which the sprinkler head is attached.

Another object of this invention is to provide a protector as described above which is very resistant to unbalanced vertical loads.

Yet another object of this invention is to provide a protector which can be easily reconfigured to fit the corner of a lawn, or along the side of the lawn.

Briefly, the improved protector of the present invention includes a guard member of unitary construction provided with a cavity receptive to the sprinkler head, and a cover assembly for preventing foreign matter from entering the cavity of the guard member. The guard member preferably has a large, square bottom surface; a small, round top surface; and a smoothly contoured side surface connecting the top surface to the bottom surface. The cavity includes three axial bores of varying diameter.

The cover assembly includes a fixed cover portion resting upon a shoulder provided within the cavity of the guard member, and a movable cover portion attached to the poppet of the sprinkler head. When the poppet is in its retracted position, the movable cover member engages the fixed cover member to provide a closure which prevents foreign matter from entering the cavity of the guard member.

A guide for the poppet is also provided which includes a central hub which engages the poppet, and a number of spokes which couple the hub to the inner surface of the cavity of the guard. The spokes are designed to break when a force is applied to the guard which might damage either the sprinkler head or the riser of the sprinkler head.

The bottom surface of the guard is provided with a number of concavities which further help resist vertical loads placed upon the guard member. The guard member also has a pair of crossing, vertical slots which allow the guard member to be reconfigured should the sprinkler head be located near the corner or edge of a lawn.

An advantage of this invention is that the sprinkler head "floats" within the cavity of the guard member, such that forces applied to the guard member are not transmitted to the sprinkler head or to the riser to which it is attached. The two piece cover assembly is designed to disengage when forces are applied to the guard, and the poppet guide is designed to break when excessive forces are applied to the guard.

Another advantage of this invention is that the guard itself is designed to resist unbalanced loads. The bottom surface of the guard has a much greater surface area than the top surface, requiring large forces to be exerted on the top surface to affect a vertical movement. The wall of the guard is concave, which tends to distribute any unbalanced force evenly along the wall, further preventing movement of the guard. Also, the concavities provided in the bottom surface of the guard serve as anchors to inhibit movement of the guard.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
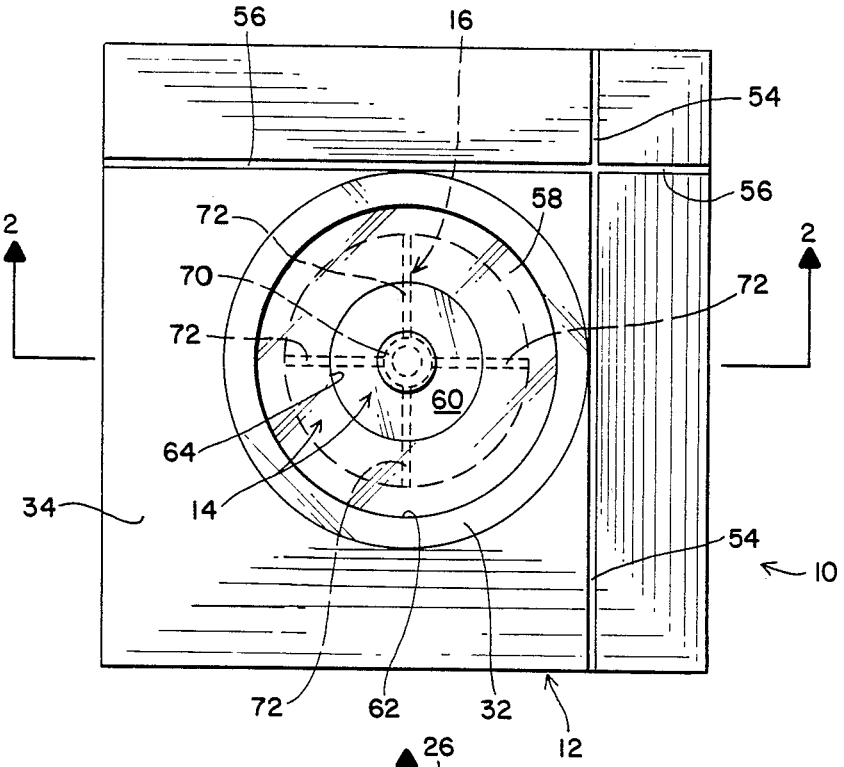
FIG. 1 is a top plan view of an improved sprinkler head and riser protector in accordance with the present invention.
Figure 2:
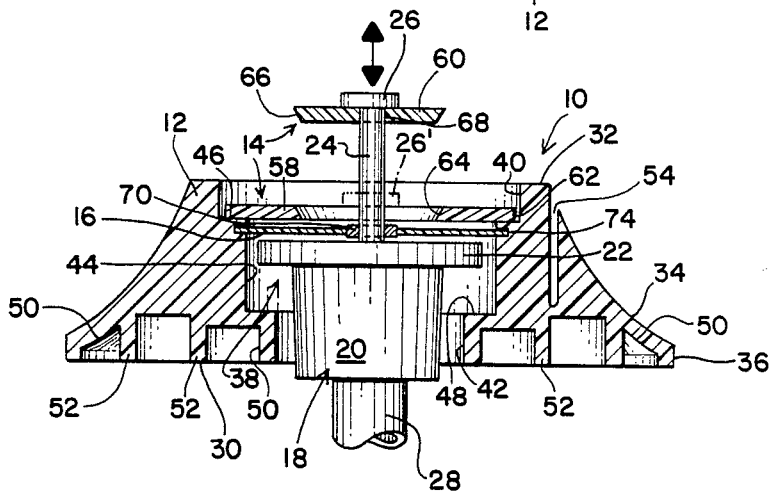
FIG. 2 is a cross sectional view taken along 2—2 of FIG. 1.

Referring to FIGS. 1 and 2, a protector 10 in accordance with the present invention includes a guard member 12 of unitary construction, a cover assembly 14, and a poppet guide 16. The protector 10 is used with a sprinkler head 18 of conventional design.

Sprinkler head 18 includes a base portion 20, a flange 22, a poppet 24, and a spray nozzle 26. The base portion 20 of sprinkler head 18 is coupled to a matrix of buried water pipes by a riser 28.

Guard 12 includes a bottom surface 30, a top surface 32, and a side surface 34 coupling the bottom surface 30 to the top surface 32. Bottom surface 30 is substantially rectangular in plan view, and top surface 32 is substantially circular in plan view. Side surface 34 is a smooth, contiguous, concave surface with the exception of a small vertical section 36 provided near bottom surface 30.

Guard 12 is provided with a cavity 38 extending between top surface 32 and bottom surface 30. Cavity 38 has three sections comprising a top bore 40, a bottom bore 42, and a middle bore 44. Top bore 40 has a greater diameter than middle bore 44, and middle bore 44 has a greater diameter than bottom bore 42, producing a stepped inner surface for cavity 38. A first shoulder 46 is created at the juncture between top bore 40 and middle bore 44, and a second shoulder 48 is created at the juncture of middle bore 44 and bottom bore 42.

The bottom surface of guard 12 is provided with a number of concavities 50 which are separated from each other by rib sections 52. As will be discussed subsequently, concavities 50 can fill with dirt to further anchor the guard 12 in position. Alternatively, concavities can be filled with a dense material such as concrete or lead to increase the weight and therefore the stability of the protector 10.

Guard 12 is also provided with a pair of vertical slots 54 and 56 extending downwardly from side surface 34 towards bottom surface 30. Vertical slots 54 and 56 are mutually perpendicular, and are tangential to the generally round top surface 30. As best seen in FIG. 1, vertical slot 54 and 56 cross each other proximate of the corners of guard 12.

Cover assembly 14 includes a fixed cover portion 58 and movable cover portion 60. Fixed cover portion 58 is a flat, annular member having an outer circumference 62 and an inner circumference 64. Inner circumference 64 is beveled as shown.

Movable cover portion 62 is also an annular member having an outer circumference 66, and an inner circumference 68. The inner circumference of movable cover portion 60 is engaged with the outer circumference of substantially cylindrical poppet 24, and the outer circumference 66 of movable cover portion 60 is beveled to matingly engage with the beveled inner circumference 64 of fixed cover portion 58.

When spray nozzle 26 is in the position shown in FIG. 2, the movable cover portion 60 is disengaged from the fixed cover portion 58. When the spray nozzle 26 moves to a retracted 26', the movable cover portion 60 matingly engages fixed portion 58 to provide a substantially solid cover preventing foreign materials from falling into cavity 38.

Riser guide 16 includes an annular hub portion 70 provided with a central aperture receptive to poppet 24, and four spokes 72 attaching hub 70 to the inner surface of cavity 38. The function of poppet guide 16 is to ensure that poppet 24 moves up and down vertically. The spokes 72 are designed to break when a force is exerted on guard 12 which is great enough to potentially harm either sprinkler head 18 or riser 28.

If the protector 10 is to be attached to a sprinkler head 18 which is located near the edge of the lawn, it may be easily reconfigured by cutting off a section of the guard 12, such as by a hacksaw, through either vertical slot 54 or 56. If the protector 10 is to be attached to a sprinkler head 18 which is near a corner of a lawn, it can be cut through both slots 54 and 56. It should be noted that the slots 54 and 56 are positioned on the outside of a rib section 52 to maintain the structural integrity of the guard 12.

To install the present device, a hole is dug into the ground surrounding a riser 28 to approximately the depth of guard 12. The guard 12 is then placed over pipe 28. The guard 12 is pressed firmly into the ground such that dirt enters concavities 50 of the guard, anchoring the guard in place. Any dirt which may have entered bottom bore 42 of guard 12 is removed, and sprinkler head 18 is engaged with the end of riser 28. Dirt is then replaced into the hole that was dug up to top surface 32, completely covering side surface 34.

It should be noted that, when in its retracted position, the entirety of sprinkler head 18 is below ground level. This protects the sprinkler head from breakage. It should be also noted that the sprinkler head is not resting on or touching any part of the inner surface 38, but rather "floats" within cavity 38.

Riser guide 16 is engaged with poppet 24 and slots 74 provided on the inner surface of cavity 38. Fixed cover portion 58 rests freely on first shoulder 46, and movable cover portion 60 is engaged with poppet 24. Finally, spray nozzle 26 is attached to the end poppet 24.

Figure 3:
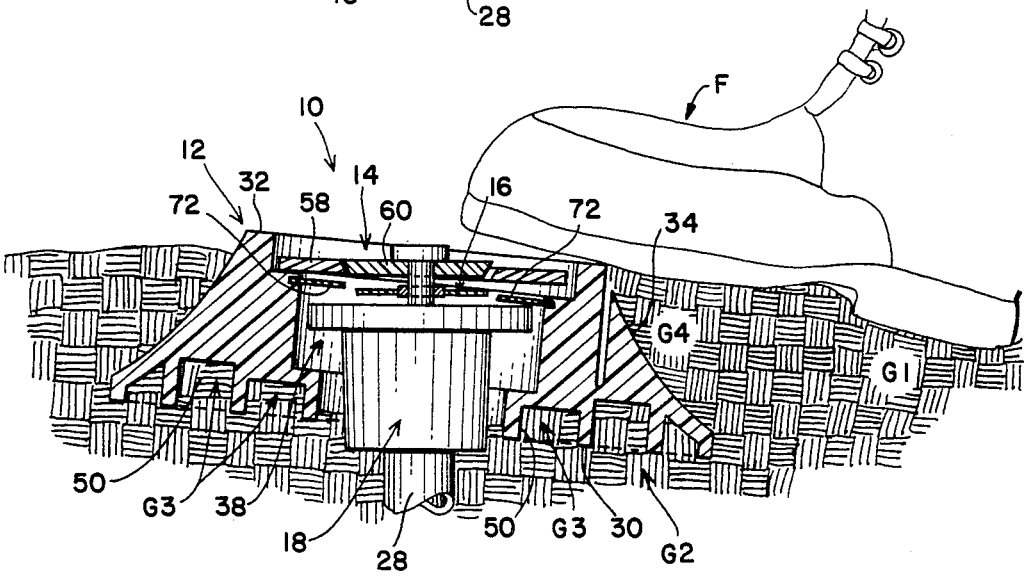
FIG. 3 is a view similar to that of FIG. 2 in situ illustrating the functioning of the device.

In FIG. 3, the operational environment of the present invention is illustrated, along with the reaction of protector 10 to an unbalanced force exerted by a foot F. It should be noted that the reaction of protector 10 to the force is exaggerated in FIG. 3 for the purpose of illustration.

The force exerted by foot F is resisted by the design of the guard 12 in several ways. Firstly, much of the force exerted by foot F is absorbed by the ground at G1 rather than the guard 12 due to the relatively small surface area of top surface 32. The force that is transmitted through guard 12 is spread across bottom surface 30 which greatly reduces the per-unit-area force exerted on the ground G2 beneath the guard 12.

Furthermore, the ground G3 within concavities 50 tends to anchor the guard 12 in place. Finally, the curved side surface 34 distributes the forces on the ground at position G4 in a manner which tends to counteract the force exerted on top surface 32 by foot F.

Still referring to FIG. 3, if the force of the foot is sufficiently great enough to overcome all of the aforementioned stabilizing effects, the sprinkler head 18 (which "floats" within cavity 38) remains in its vertical, unstressed position because movable cover portion 60 will disengage from fixed portion 58, and rib sections 52 of poppet guide 16 will break. Thus, virtually none of the force exerted by Foot F is transmitted to either sprinkler head 18 or the riser 28 which it is attached.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. An improved protector for a sprinkler head and for a riser for said sprinkler head, where the sprinkler head is of the type including a base, a spray nozzle, and a cylindrical poppet coupling said spray nozzle to said base for moving said spray nozzle between an elevated position and a retracted position, and where the riser connects said base of said sprinkler head to a pressurized water supply; said protector comprising:

a guard member of unitary construction, said guard member having a substantially square bottom surface having a plurality of upwardly extending concavities, a substantially round top surface having a surface area substantially less than the surface area of said bottom surface, a contiguous and concave side surface connecting said bottom surface to said top surface, said side surface being provided with a pair of vertical separation slots extending downwardly from said side surface towards said bottom surface, where said pair of slots are perpendicular to and intersect each other and are tangential to said top surface, and a cavity extending between said top surface and said bottom surface which is receptive to said sprinkler head, where the inner surface of said cavity is not in contact with said sprinkler head when said sprinkler head is inserted into said cavity, wherein said cavity includes a bottom bore extending upwardly from said bottom surface, and a top bore extending downwardly from said top surface, said top bore having a larger diameter than said bottom bore, and further comprising a middle bore extending between a bottom of said top bore and a top of said bottom bore, said middle bore having a diameter less than that of said top bore to provide a first shoulder, and said middle bore having a diameter greater than that of said bottom bore to provide a second shoulder;

cover means including a fixed cover portion coupled to said guard member, wherein said fixed cover portion is annular member having an outer diameter substantially the same as a diameter of said top bore, said fixed cover portion being adapted to rest upon said first shoulder of said guard, and wherein said movable cover portion is an annular member having an outer diameter substantially the same as an inner diameter of said fixed cover member, and having an inner diameter substantially the same as the outer diameter of said poppet, and a movable cover portion coupled to said poppet, said fixed cover portion and said movable cover portion being matingly engagable when said poppet is in said retracted position; and a poppet guide including a hub portion having an aperture receptive to said poppet and a plurality of spoke portions coupling said hub portion to said inner surface of said cavity.

2. An improved protector as recited in claim 1 wherein said spoke portions are designed to break when pressure is applied to said guard.

3. An improved protector for a sprinkler head and for a riser for said sprinkler head, where the sprinkler head is of the type including a base, a spray nozzle, and a cylindrical poppet coupling said spray nozzle to said base for moving said spray nozzle between an elevated position and a retracted position, and where the riser connects said base of said sprinkler head to a pressurized water supply; said protector comprising:

a guard member of unitary construction, said guard member having a bottom surface, a top surface having a surface area substantially less than the surface area of said bottom surface, a contiguous side surface connecting said bottom surface to said top surface, and a cavity extending between said top surface and said bottom surface which is receptive to said sprinkler head, where the inner surface of said cavity is not in contact with said sprinkler head when said sprinkler head is inserted into said cavity;

cover means including a fixed cover portion coupled to said guard member, and a movable cover portion coupled to said poppet, said fixed cover portion and said movable cover portion being matingly engagable when said poppet is in said retracted position; and a poppet guide including a hub portion having an aperture receptive to said poppet and a plurality of spoke portions coupling said hub portion to said inner surface of said cavity, wherein said spoke portions are designed to break when pressure is applied to said guard member.

4. An improved protector as recited in claim 3 wherein said bottom surface is substantially square, said top surface is substantially round, and said side surface is concave.

5. An improved protector as recited in claim 3 further comprising a plurality of upwardly extending concavities in said bottom surface.

6. An improved protector as recited in claim 3 further comprising a pair of separation vertical slots extending downwardly from said side surface towards said bottom surface, where said pair of slots are perpendicular to and intersect each other and are tangential to said top surface.

7. An improved protector as recited in claim 3 wherein said cavity in said guard includes a bottom bore extending upwardly from said bottom surface, and a top bore extending downwardly from said top surface, said top bore having a larger diameter than said bottom bore.

8. An improved protector as recited in claim 7 wherein said cavity in said guard further comprised a middle bore extending between the bottom of said top bore and the top of said bottom bore, said middle bore having a diameter less than that of said top bore to provide a first shoulder, and said middle bore having a diameter greater than that of said bottom bore to provide a second shoulder.

9. An improved protector as recited in claim 3 wherein said fixed cover portion is an annular member having an outer diameter substantially the same as the diameter of said top bore, said fixed cover portion being adapted to rest upon said first shoulder of said guard, and wherein said movable cover portion is an annular member having an outer diameter substantially the same as an inner diameter of said fixed cover member, and having an inner diameter substantially the same as the outer diameter of said poppet.

* * * * *